United States Patent [19]

Mayes

[11] Patent Number: 4,948,125

[45] Date of Patent: Aug. 14, 1990

[54] ELECTRONIC SCOREKEEPER FOR DICE GAME

[76] Inventor: Robert J. Mayes, 701 Grattan, Stockton, Calif. 95205

[21] Appl. No.: 404,121

[22] Filed: Sep. 6, 1989

Related U.S. Application Data

[63] Continuation-in-part of Ser. No. 174,704, Mar. 29, 1988, abandoned.

[51] Int. Cl.[5] ..... A63B 67/00

[52] U.S. Cl. ..... 273/1 ES; 273/148 R; 340/323 R

[58] Field of Search ..... 273/1 E, 1 ES, 148 R, 273/29 R, 29 A; 340/323 R

[56] References Cited

U.S. PATENT DOCUMENTS

| | | | |
|---|---|---|---|
| 4,097,855 | 6/1978 | Salvo | 340/323 R |
| 4,193,600 | 3/1980 | Armstrong et al. | 273/1 ES |
| 4,237,372 | 12/1980 | Zevgolis et al. | 340/323 R |
| 4,368,516 | 1/1983 | Morin | 340/323 R |
| 4,479,181 | 10/1984 | Hannah | 273/1 ES |
| 4,751,506 | 5/1988 | Brown | 273/1 ES |

FOREIGN PATENT DOCUMENTS

| | | | |
|---|---|---|---|
| 2552999 | 4/1985 | France | 273/1 ES |

*Primary Examiner*—Edward M. Coven
*Assistant Examiner*—Dean Small
*Attorney, Agent, or Firm*—Mark C. Jacobs

[57] ABSTRACT

An electronic scoring device for use by two contestants playing Boss Dice. When a first contestant wins a Hand or Round, he/she pushes his switch and a hand or game light is illuminated on his side of the scorekeeper device to rotate the advantage. If the same contestant wins the second hand or game, the same switch is pushed and the numeral "1" appears on a display to note the winner of the first game (here two straight hands) and the circuitry causes the first hand or round light to go out. In the next case where both contestants have won one round each, both game lights will have been illuminated on the scorekeeper by each contestant having pushed his respective switch. The winner of the third and final round, pushes his switch, causes the digital display to advance one digit on his display and both round lights are extinguished. The process is repeated and the numberals on the displays are cumulative, thus resulting in totalization of game scores for a series of games until the predetermined number of games has been reached.

6 Claims, 4 Drawing Sheets

ELECTRONIC SCOREKEEPER FOR DICE GAME

RELATION TO OTHER APPLICATION

This application is a continuation-in-part of my pending application Ser. No. 174,704 filed Mar. 29, 1988 which is now abandoned.

BACKGROUND OF THE INVENTION

1. Field of the Invention

The present invention pertains to the field of game scoring devices and more particularly relates to an electronic scorekeeper for the dice game generally known as "Poker Dice or Boss Dice, but this scorekeeper may also be used in other games played between two contestants where the winner of two out of three hands or events wins the game and the games are cumulative. The scorekeeper, being portable, is especially well adapted to cocktail lounges and taverns where dice games are commonly played on the bar for drinks.

2. Background of the Invention

The dice games commonly know as Poker Diver or Boss Dice (hereinafter called Boss Dice) is usually played by two contestants with five dice apiece for the highest hand. Each contestant begins by rolling all five dice and the one player with the highest dice count hand is called the "boss". The opponent player then keeps any number of his dice and rolls the remainder trying to fill in his hand to be the "boss". Of course there are other rules beyond these basics, but these are not necessary for an understanding of the nature and quality of this invention.

The party with the highest point count from his five dice is declared the winner of the round or hand and is said to have a "Horse" on the other player; i.e. an advantage. The process is repeated until one player wins two out of three sequential rounds or hands. The winner of such two out of three sequenced rounds wins a "game" and is granted one (1) point. Play is continued until a predetermined number of points are collected by one player, for example, 25.

Heretofore, the cumulative score of a series of Boss Dice games were kept by a variety, and sometimes unusual means ranging from counting match sticks to scribing, but with the advent of electronic logic circuits, digital displays and calculators, several electronic game counters have greatly simplified scorekeeping, but none of these are especially suitable for Boss Dice.

STATUS OF THE PRIOR ART

In the U.S. Pat. No. 4,567,461, Honekan and Fisher disclose an electronic dart game scoreboard especially adapted for the game of cricket, while in U.S. Pat. No. 3,836,148, Manning discloses a unit point scoring system where the outcome of the game depends upon which team scores the most unit points.

In U.S. Pat. No. 4,045,788, Castelli, Forrester and Symosko disclose an all purpose portable scoreboard with a clock for a variety of sporting events, and in U.S. Pat. No. 3,959,640, Syria discloses a computer system for scoring athletic events where score inputs from remote locations can be recorded.

MacKenzie discloses a manually operated game counter for the game of cribbage, in U.S. Pat. No. 3,651,313; and U.S. Pat. No. 4,130,871 discloses an electronic computer for computing and displaying the scores of players playing the game of Bridge.

Other scorekeeping devices known to applicant include Kurtenbach, U.S. Pat. No. 3,727,213 and Zevgolis U.S. Pat. No. 4,237,372. While Kurtenbach is an electronic device that uses a logic system, the thrust of the invention is a clock and indicator control means to increment the clock when a wrestler gains advantage time and to decrement the clock when that wrestler loses advantage time. Neither Kurtenbach nor Zevgolis pertain in any way to the counting of the winning of two out of three events for Boss Dice or any other game. In fact, there is no known electronic scorekeeper for the game of Boss Dice.

It is an object therefore of this invention to provide an electronic scorekeeper for the game of Boss Dice.

It is another object of this invention to provide a device that notates the winner of two out of three sequenced events and advances a counter numerically.

It is another object to provide an electronic scorekeeper for Boss Dice that advises the players who has the advantage at a point in time; and the number of rounds played.

It is a further object to provide an electronic scorekeeping device which numerically counts the winner of two out of three sequenced events with means for counting the number of games won and with reset means.

This and other objects of the invention will in part be obvious and will in part appear hereinafter.

The invention accordingly comprises the product possessing the features, properties and the relation of components which are exemplified in the following detailed disclosure and the scope of the application of which will be indicated in the claims.

For a fuller understanding of the nature and objects of the invention reference should be made to the following detailed description taken in conjunction with the accompanying drawings.

SUMMARY OF THE INVENTION

An electronic scoring device for use by two contestants playing Boss Dice. When a first contestant wins a Hand or Round, he/she pushes his switch and a hand or game light is illuminated on his side of the scorekeeper device to notate the advantage. If the same contestant wins the second hand or game, the same switch is pushed and the numeral "1" appears on a display to note the winner of the first game (here two straight hands) and the circuitry causes the first hand or round light to go out.

In the next case where both contestants have won one round each, both game lights will have been illuminated on the scorekeeper by each contestant having pushed his respective switch. The winner of the third and final round, pushes his switch, causes the digital display to advance one digit on his display and both round lights are extinguished. The process is repeated and the numerals on the displays are cumulative, thus resulting in totalization of game scores for a series of games until the predetermined number of games has been reached.

DESCRIPTION OF THE PREFERRED EMBODIMENTS

Figure 1:
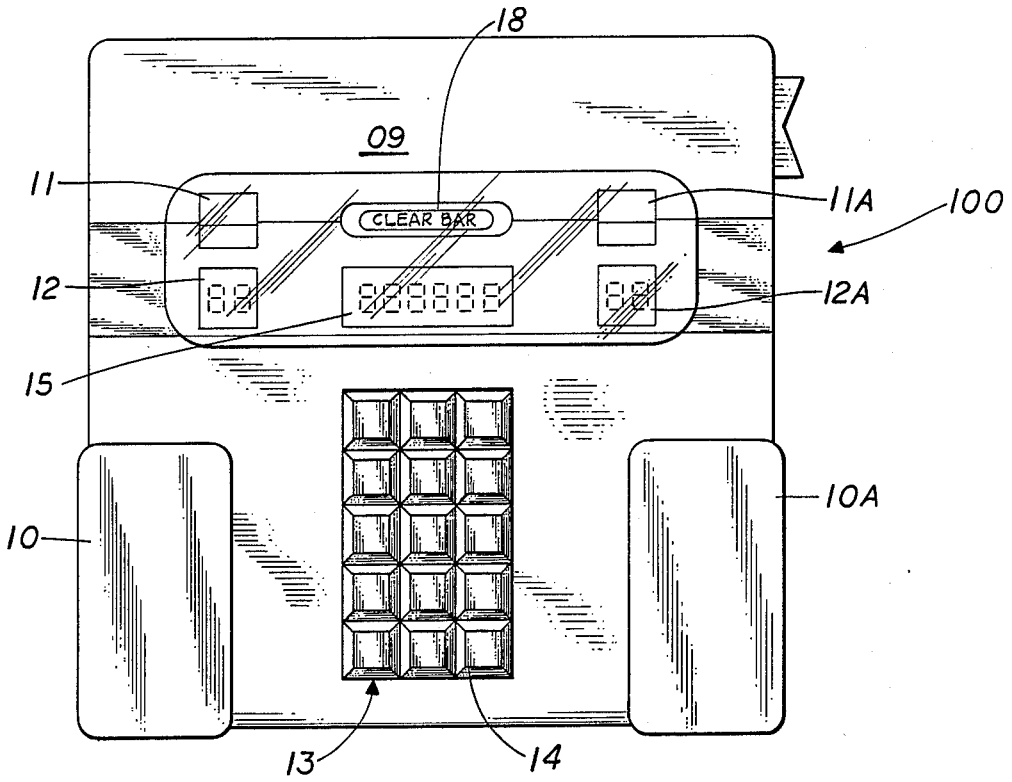
FIG. 1 is a top elevational view of the casing module for the present invention.

Referring to FIG. 1, wherein the device 100 is shown. It features a casing module 09, upon which are mounted the individual scoring switches designated 10 and 10A, respectively. When the individual scoring switch, either 10 or 10A is depressed, illumination of the respective light such an LED 11 or **11*a*** takes place since each is respectively electrically connected to its switch. The first such switch depression after the commencement of play notates the advantage to that player.

If the same scoring switch is depressed again, indicating a win for the second round by the same player who won round one, both LED's 11 and **11*a* will be extinguished (one of said LED's was already in the off state) and a number "one" will appear on the respective digital counter 12, or 12A** associated with that player, again due to the circuitry involved. Typically an LED display is employed to indicate the game score.

Play is continued in this fashion as long as desired. If a first player wins round one, and depresses his switch to note the advantage, it is seen that the number of rounds is readily ascertained since one LED light will be on and the other off. Should the second player win the second round, and depress his/her switch, her light such as LED **11*a* is illuminated. The illumination of both LED's 11 and 11A is again a reminder of the status of play, i.e. the completion of two of the necessary rounds for a game. As noted above, whoever wins the third round, will upon depression of his respective switch cause both LED's 11, 11*a*** to extinguish and the digital counter will advance one number.

To play additional games the process is repeated again until the cumulative score shown by the respective digital counters such as LED 12 or **12*a*** reaches the pre-agreed upon number.

A clear bar 18 may be depressed by either player at any time to extinguish both LED's 11 and **11*a*, and also to reset both digital display LED's 12 and 12*a*** to show "zero".

An optional conventional calculating means 13, having a keyboard 14 may be used for mathematical calculations with the results of such calculations being shown in a separate digital display 15. It should be pointed out here that the calculating means 13 is not claimed as part of the present invention and as such there is no circuitry shown in the figures for same. It is only included in this specification as a convenience feature since nowadays many devices incorporate them due to ready availability and low cost.

Figure 2:
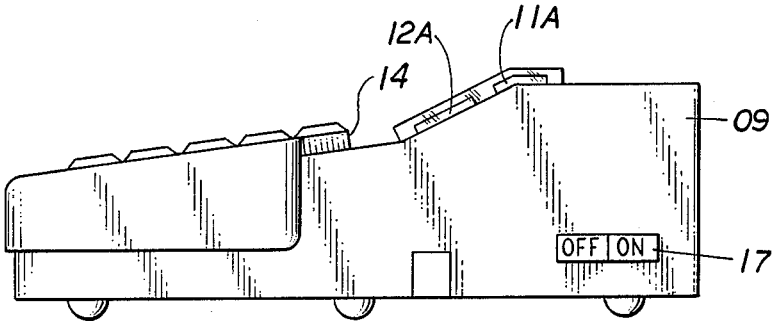
FIG. 2 is a right side elevational view thereof.
Figure 3:
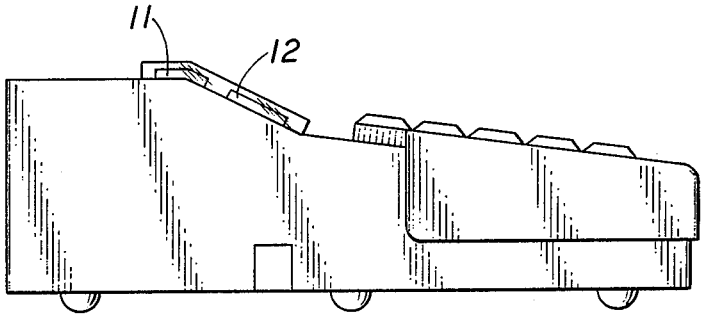
FIG. 3 is a left side elevational view thereof.
Figure 4:
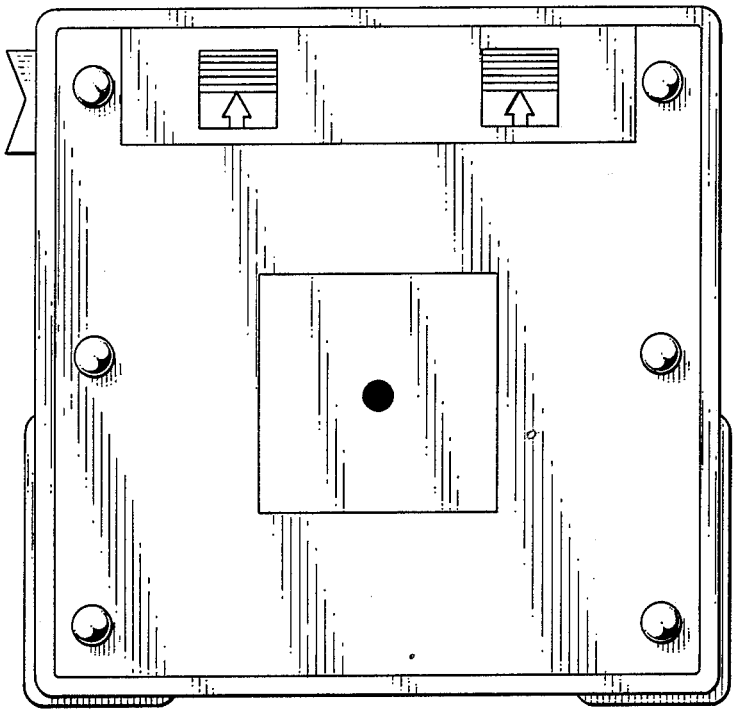
FIG. 4 is a rear elevational view thereof.

FIG. 2, which is a right side elevation view of the present invention, shows the preferred location of the main on-off switch 17, which controls all of the above said circuits in the casing module, 09. FIG. 3, the left side elevational view of the present invention is shown for illustrative and design purposes only, as is FIG. 4, the rear elevational view. Obviously switch 17 could be mounted on the left side of the module if desired.

Figure 5:
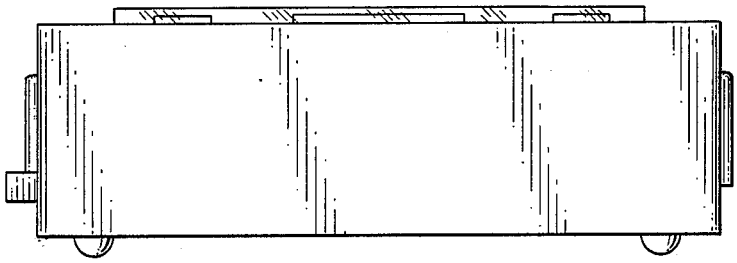
FIG. 5 is a bottom elevational view thereof.

FIG. 5, the bottom elevational view of the casing module, shows a removable cover 18, wherein rechargeable batteries such as those nickel-cadmium and a suitable battery mount means are contained for portable operation of the present invention. An optional electrical cord for 110 volt AC operation can be stowed in this location also.

Figure 6:
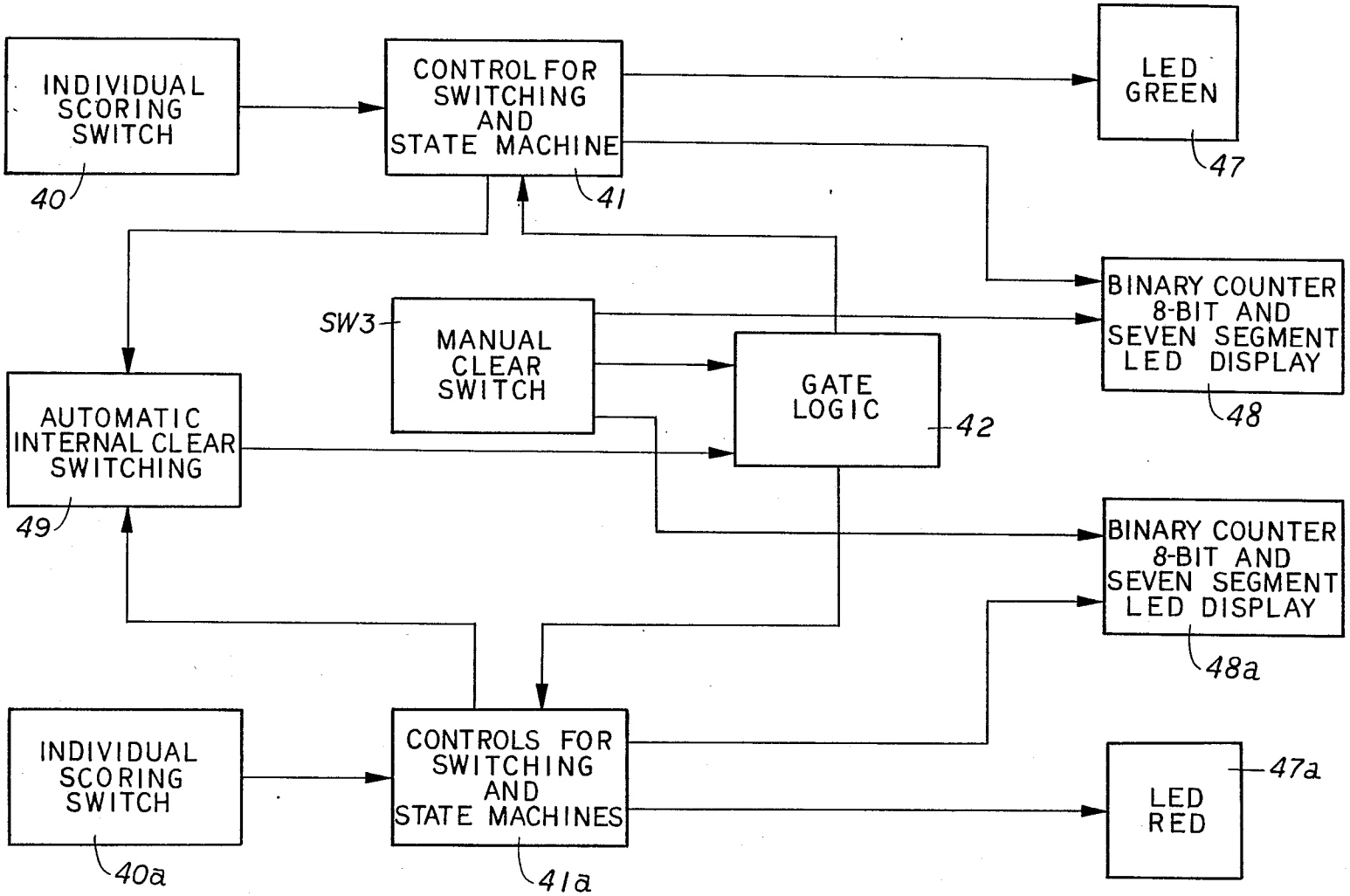
FIG. 6 is a block diagram of the logic circuitry.

FIG. 6 is a block diagram of the circuitry of the present invention which permits the activities discussed above to take place. Thus the individual scoring switch circuitry 40 and **40*a* is individually and separately activated by a player when momentarily depressing and respectively activating lever (10 or 10*a* in FIG. 1). Such depression sends a pulse signal to its respective memory control circuit 41 or 41*a*. A gate logic 42 then determines whether to send a signal to LED's 47 or 47*a*, or binary counters 48 or 48*a* by the following manner. When none of the LED's are illuminated (no score nor rounds), gate logic 42 will pass the signal to the round or hand LED 47 or 47*a*. When one event LED, for example 47, is illuminated, the gate logic 42 will pass a second signal from individual scoring switch 40 to binary counter 48 and extinguish LED 47**, thus recording a single score for winning two or three possible hands or rounds.

If, for example, LED 47 is illuminated and individual scoring switch **40*a* is pushed by the other player, gate logic 42 will pass the signal to the other LED 47*a*. When both LED's 47 and 47*a* are illuminated (one round each), the gate logic 42 will pass the next signal from the individual scoring switch to its respective binary counter 48 or 48*a*, and also extinguish both LED's 47 and 47*a*, by way of the automatic internal clear switching circuitry 49**. A manual clear switching circuit SW3 allows any player to clear all illuminated LED's and return the binary counters to "zero".

By the above means, the present invention adds the cumulative score of each winner of two out of three possible hands or rounds, i.e. games up to and including ninety-nine games. Obviously if the digital counters had three digits, as is also contemplated, then the maximum score would be 999 games.

Reference is now made to FIG. 8, which is a schematic diagram of the circuit of the present invention. It is seen that the manually operated circuit switches are designated SW1, SW2 and SW3. When a competitor playing the game wishes to record a hand or round, SW1, for example, is manually and momentarily closed which generates a signal to the monostable multivibrator 70. The outputs Q of the two D-flip flops 71 and 72 are initially logic LOW at the start of the game (as are **71*a* and 72*a*), but the signal from the monostable multivibrator 70 causes D-flip flop 71 output Q to go logic HIGH (1,0) because the input of NAND gate 73 is connected to the output Q of D-flip flop 71*f* and to the output Q of D-flip flop 72. The signal of NAND gate 75 is then inverted 76, which results in illumination of LED 77** to record a score for a single event, i.e. a round by one player.

If SW1 is activated again, the LED 77 will go out and a binary counter 78 will record the winning of two out of three rounds while displaying the numeral "one" according to the following means.

When the D-flip flop 72 output Q is logic LOW in the above example, the 8-bit binary counter 78 remains at binary 0. When SW1 is activated a second time, another pulse signal is generated to the monostable multivibrator 70. At this point the outputs Q of D-flip flops 71 and 72 are respectively logic HIGH and LOW (1,0). A second signal causes the output Q of D-flip flop 72 to go logic HIGH by way of AND gate 74. When the outputs Q of both D-flip flops 71 and 72 are logic HIGH (1,1), the output signal of NAND gate 75 is also logic HIGH b-tu-is inverted 76 and causes LED 77 to shut off. The logic HIGH output Q of D-flip flop 72 is also the pulse signal to the clock input of the binary counter 78 which counts a binary one indicating a game score.

The above example of the involves a situation where one competitor wins two rounds in a row. Very often however, each competitor will win one hand or round apiece and therefore a third hand or round is required for determination of the ultimate game score.

Figure 7:
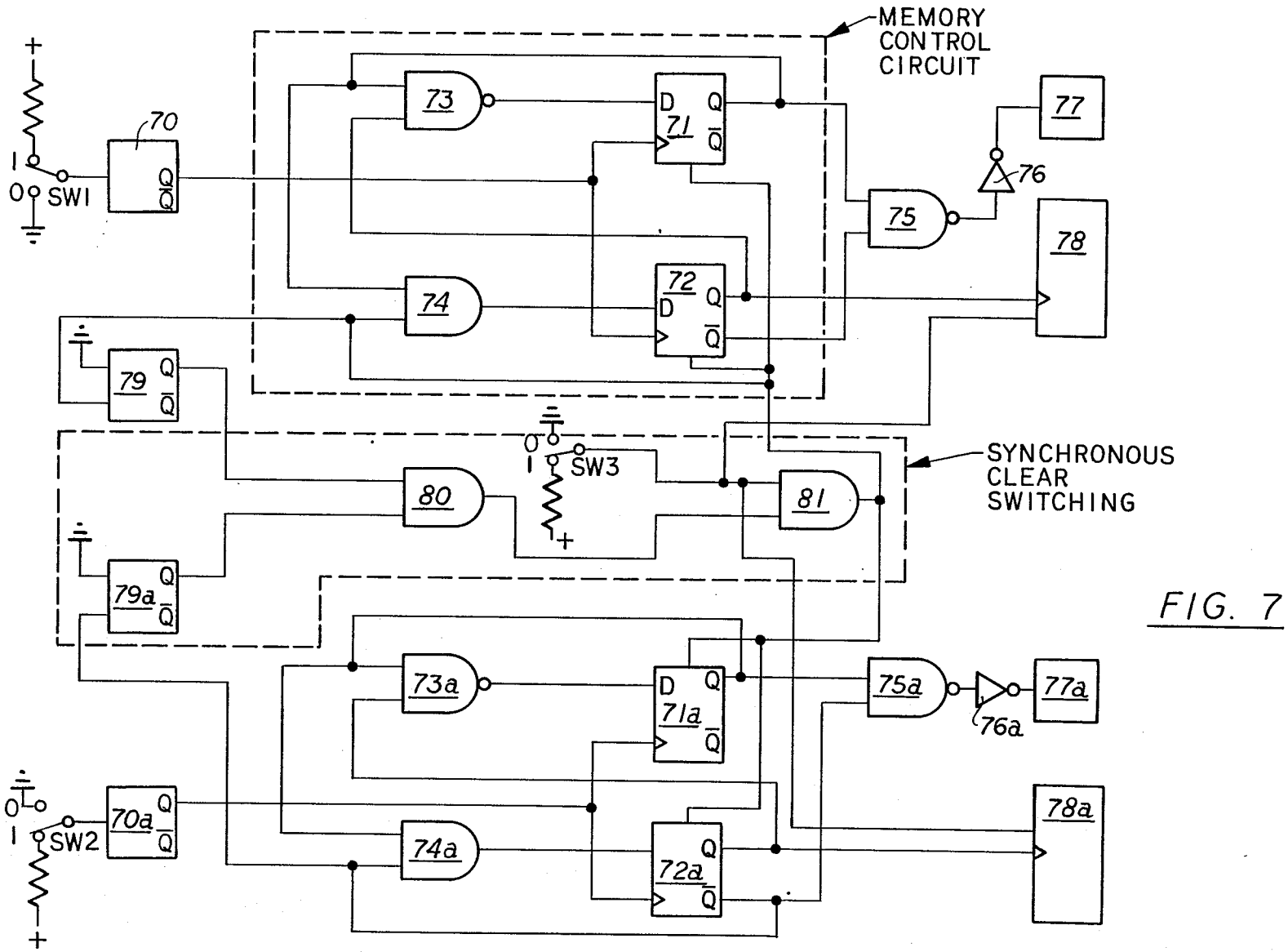
FIG. 7 is a electrical circuitry diagram of this invention.

For example, SW1 may be activated by one player and then SW2 may be activated by the second player which results in one round apiece as shown by illumination of both LED's 77 and 77*a*. Without the necessity of repeating the logic of circuitry for the second circuit activated by SW2, it may need only be said that this circuit is separate but identical to the circuit activated by SW1, with FIG. 7 subscripts in letters referring to like reference numbers for like components.

To play a third and final hand or round, both LED's 77 and 77*a* must be illuminated from the two prior rounds wherein each player won one round. When either SW1 or SW2 is activated again, i.e. the winner of the third round depresses his/her switch, either SW1 or SW2's respective D-flip flops Q go logic HIGH (1,1) and this causes its respective retriggerable multivibrator 79 or 79*a* output Q to go logic LOW (0,1), which in turn resets all D-flip flop output Q's to logic LOW and causes both LED's 77 and 77*a* to go out. Thus, a new series of two out of three hands or rounds may start anew.

Any suitable materials may be employed for the casing module such as metal—aluminum or steel; or plastic such as polystyrene or polysulfone. All of the electrical components recited above are off the shelf and readily available. This is of course true for the rubber feet 25 that are used to support this device.

It is to be understood, of course, that the foregoing describes a preferred embodiment of the present invention and that modifications may be made therein without departing from the spirit or scope of the present invention as set forth in the appended claims.

It is also to be seen that while the device of this invention is specifically intended for use in the scoring of Poker Dice, that it may be utilized for the scoring of any game or sport that requires the winning of two out of three subevents or rounds, to be designated the winner of a GAME of that sport or game.

I claim:

1. A two person poker dice game scorekeeping device for recording as an individual round the winner of any single roll of dice, and for counting as a game event, the winner of two out of three sequential rolls of dice, said device comprising:

a. exterior switch activation means manually operable by each player, for scoring an individual round won by either player, mounted on a casing module;

b. illuminating light means for each player for the recording of an individual round won;

c. digital display means for each player for recording as a single game event the winner of two out of three consecutive rounds;

d. computerized logic circuitry means comprising in combination:

I. clock subsystem means consisting of a plurality of synchronized D-type flip flops in respective logic High and Low states, each connected the their respective NAND and AND gates whereby input from said switch activating means causes said flip flops to change logic states and to pass a signal through their respective logic gates to the respective illuminating light means or digital display means;

II. switch clearing D-type flip flops and logic gate means in, switch activation with said clock subsystem means, whereby one of said light means is activated upon activation of an exterior switch activation means upon the winning of a single roll of dice, and further whereby any and all light means so lit are extinguished upon activation of any one exterior switch two out of three sequential times of exterior switch activation, and still further when any lit light means are extinguished the digital display means connected to the exterior switch which has been activated two out of three consecutive times, counts one unit for the winner of that event.

2. The device of claim 2 further including circuit logic new series of games.

3. The device of claim 1 further including a calculating means disposed in said module.

4. The device of claim 1 wherein the light means of each player which is used to note the advantage of having won one round is an LED.

5. The device of claim 1 wherein the digital display means are each an LED based counter.

6. The device of claim 2 wherein the light means of each player which is used to note the advantage of having won one round is an LED and further wherein the digital display means are each an LED based counter.

* * * * *